US006196448B1

(12) United States Patent
Correll

(10) Patent No.: US 6,196,448 B1
(45) Date of Patent: Mar. 6, 2001

(54) HEAT-RETAINING FOOD CARTON

(76) Inventor: John D. Correll, 8459 Holly Dr., Canton, MI (US) 48187

( * ) Notice: Subject to any disclaimer, the term of this patent is extended or adjusted under 35 U.S.C. 154(b) by 0 days.

(21) Appl. No.: 09/378,656

(22) Filed: Aug. 20, 1999

(51) Int. Cl.[7] ..... B65D 5/56

(52) U.S. Cl. ..... 229/103.11; 229/185.1; 229/902

(58) Field of Search ..... 229/103.11, 122.32, 229/122.34, 149, 151, 153, 173, 185.1, 902, 906; 426/115, 118

(56) References Cited

U.S. PATENT DOCUMENTS 564,592 * 7/1896 Craw ..... 229/185.1
579,105 * 3/1897 Brown ..... 229/173
618,468 * 1/1899 Knobeloch ..... 229/122.32
690,575 * 1/1902 Herre ..... 229/173
1,566,505 * 12/1925 Pinkerton ..... 229/185.1
1,649,088 11/1927 Tinsley .
1,908,841 * 5/1933 Hawks ..... 229/906
2,620,116 * 12/1952 McDonough ..... 229/122.34
4,530,459 * 7/1985 Maroszek ..... 229/122.32
4,809,908 * 3/1989 Keefe et al. ..... 229/153
4,957,237 * 9/1990 Madonna et al. ..... 229/906
5,223,121 * 6/1993 Dickie et al. ..... 229/185.1
5,269,457 * 12/1993 De La Fuente ..... 229/151
5,615,796 * 4/1997 Rench ..... 229/906
5,921,466 7/1999 Speese et al. ..... 229/114

* cited by examiner

*Primary Examiner*—Gary E. Elkins

(57) ABSTRACT

A hot food carton having a heat-retention structure comprising a unitary plurality of hingedly connected heat-retention panels disposed interior to the walls, cover, and bottom panel of the carton. Also included with the carton is a cover closure retention means providing for secure cover closure without use of a cover front flap. Intended uses include packaging of pizza, breadsticks, chicken wings, and fried foods.

10 Claims, 3 Drawing Sheets

HEAT-RETAINING FOOD CARTON

FIELD OF THE INVENTION

This invention relates to cartons made of foldable material and, in particular, to corrugated blanks and boxes for hot food products such as pizza, breadsticks, and other hot foods.

DESCRIPTION OF THE PRIOR ART

In the restaurant and pizza industries, each year millions of orders of "side items" are packaged for delivery and carry-out. Examples of such products include breadsticks, chicken wings, and fried foods like onion rings, fried mozzarella sticks, and french fried potatoes.

Most companies have three main objectives in packaging these foods. First, they want to retain the product's heat or, more precisely, they want to reduce transfer of heat from the food product through the panels of the carton. Second, they want to prevent the product from becoming soggy as a result of water condensation forming on the inner surfaces of the carton. (Water condensation derives from steam released by the hot food.) Third, they want a carton that will accomplish the first two objectives in a cost-effective manner.

Companies have found ways of achieving either of the first two objectives individually but have had difficulty achieving both simultaneously. For example, to accomplish the heat retention objective, companies can use a high-insulating styrofoam-type carton. However, this results in condensation forming inside the carton which, in turn, creates a soggy food product. Conversely, companies can resolve the condensation problem by using a conventional-style carton made of corrugated paperboard, but this type of carton tends to result in delivery of "cold" food due to rapid dissipation or loss of heat from the food product through the walls, cover, and bottom panel of the carton. So there has remained a problem in the restaurant and pizza industries of how to retain the heat of hot carry-out foods while also avoiding condensation build-up inside the carton.

In addition, companies also desire packaging that is cost-effective or uses no more material than is absolutely necessary to accomplish the first two objectives. A way of reducing material in a fold-up style of corrugated box is to eliminate the front flap on the cover panel. However, in virtually all styles of fold-up corrugated boxes a cover front flap is required for maintaining the cover in a closed position. However, if a means could be provided for achieving cover closure without a cover front flap or any other material-consuming flap, it would be highly desirable.

Prior art pertaining to heat-retaining corrugated boxes is virtually non-existent. However, a pertinent box is disclosed by Tinsley U.S. Pat. No. 1,649,088 granted Nov. 15, 1927.

Prior art pertaining to fold-up corrugated boxes having no cover front flap is also minimal. However, a box having a pertinent cover closure retention means is disclosed by Speese et al. U.S. Pat. No. 5,921,466 granted Jul. 13, 1999.

However, neither of these prior art references discloses a carton that (a) eliminates condensation and also provides a substantial reduction in heat loss through the walls and cover panel of the carton and (b) provides for retention of the cover in closed position without use of a cover front flap.

In conclusion, it would be highly desirable to provide a paperboard carton that eliminates condensation and simultaneously provides for reduced heat loss. In addition, it would be advantageous to provide a means for securing cover closure without use of a cover front flap. Such a box would solve the above-described problems associated with hot food packaging and achieve the above-described three objectives. In turn, this would enable restaurant and pizzeria companies to provide enhanced-quality products. My invention enables all of that to be done.

OBJECT AND ADVANTAGES

Accordingly, the main object of my invention is a cost-effective carton that provides enhanced heat retention while avoiding condensation build-up. The advantage of this carton is enhanced quality of delivery and carry-out foods.

A secondary object of my invention is a corrugated carton that provides a means of retaining the carton's cover in closed position without use of a cover front flap. The advantage of this is material and cost savings.

Further objects and advantages of the invention will become apparent from consideration of the following detailed description, related drawings, and appended claims.

SUMMARY OF THE INVENTION

In accordance with the invention, a box is created that incorporates one or both of the following structures:

(a) a heat-retention structure comprising a unitary plurality of hingedly connected heat-retention panels disposed inside the box, or interior to the bottom panel, walls, and/or cover panel of the box;

(b) a cover closure retention means for a cover panel that has no front flap, the cover closure retention means comprising a cover side flap disposed in a flap-receiving slit in a fold line joining a front corner flap to a side wall.

A complete understanding of the invention can be obtained from the detailed description that follows.

LIST OF REFERENCE NUMERALS

Figure 1:
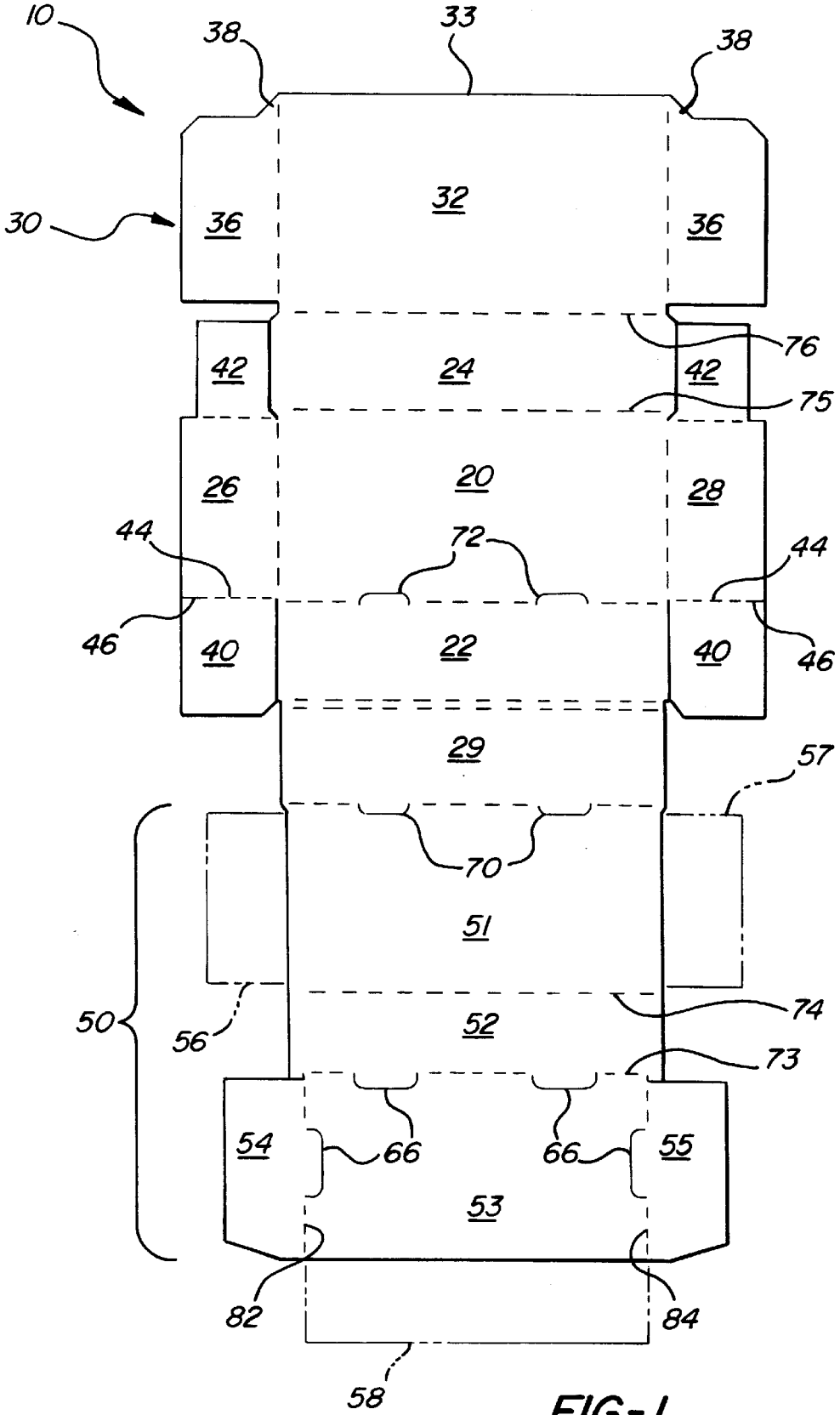
FIG. 1 is a plan view of a blank of the preferred embodiment of the invention.

Between drawings, like reference numerals designate corresponding parts.

10 blank of the preferred embodiment
12 box of the preferred embodiment
20 bottom panel
22 first wall (front wall)
24 second wall (rear wall)
26 third wall (left side wall)
28 fourth wall (right side wall)
29 inner panel
30 cover
32 cover panel
33 cover front edge
36 cover side flap

38 forward-projecting portion
40 front corner flap
42 rear corner flap
44 corner flap fold line
46 flap-receiving slit
50 heat-retention structure
51 first heat-retention panel
52 second heat-retention panel
53 third heat-retention panel
54 fourth heat-retention panel
55 fifth heat-retention panel
56 optional sixth heat-retention panel
57 optional seventh heat-retention panel
58 optional eighth heat-retention panel
62 upper air chamber
64 lower product-carrying chamber
66 slot-forming slit (also opening in panel 53)
68 upward projecting tab
70 interlock tab
72 slot-forming slit
73 fold line
74 fold line
75 fold line
76 fold line
78 side air chamber
82 fold line
84 fold line

DESCRIPTION OF THE PREFERRED EMBODIMENT

Referring now to the drawings, there is illustrated a preferred embodiment of the invention in the format of a one-piece corrugated paperboard blank and, correspondingly, in the format of a box created from the blank. The intended use for the embodiment is as a food carton or, specifically, a box for packaging side item food products such as chicken wings, breadsticks, and the like. However, it will be appreciated, as the description proceeds, that my invention may be realized in different embodiments and may be used in other applications.

Figure 2:
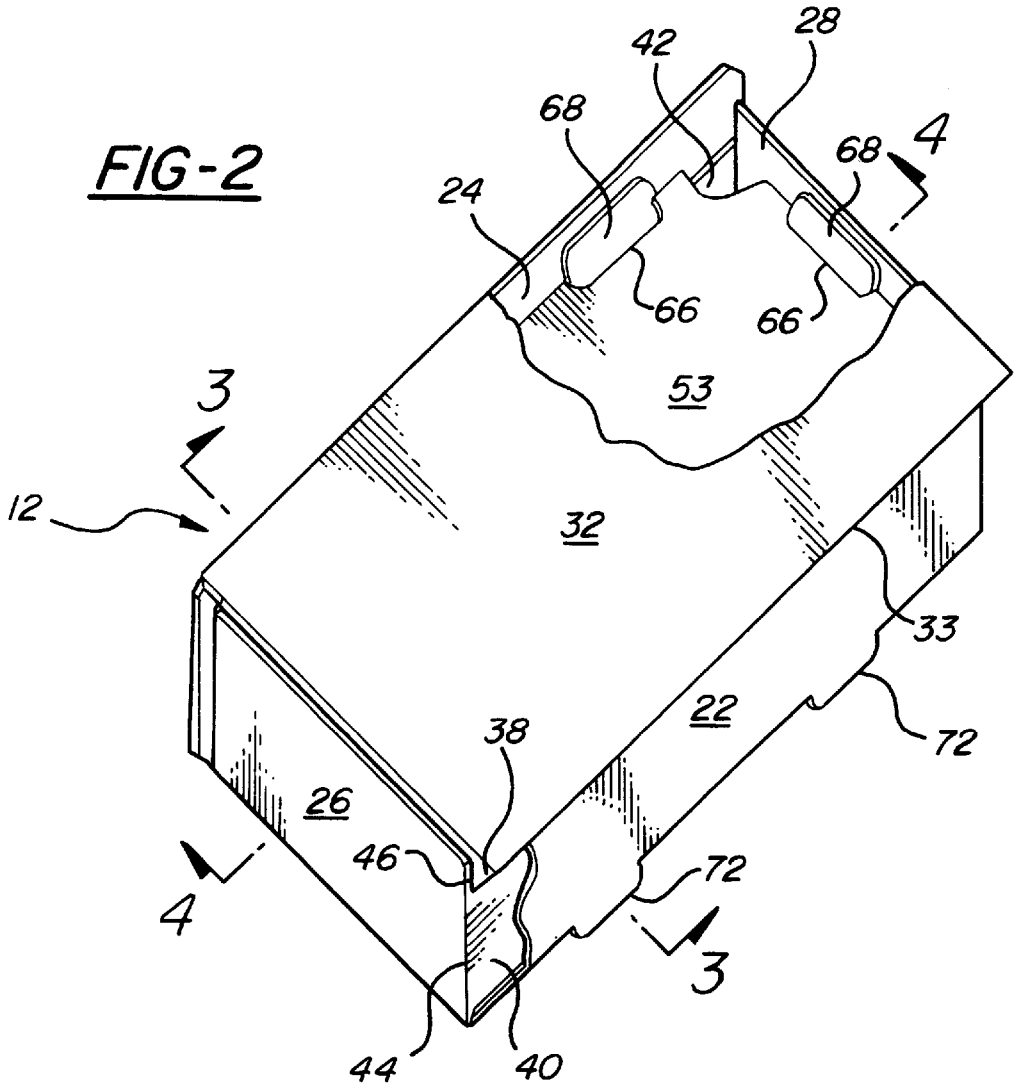
FIG. 2 is a perspective view of a carton formed from the blank of FIG. 1.
Figure 3:
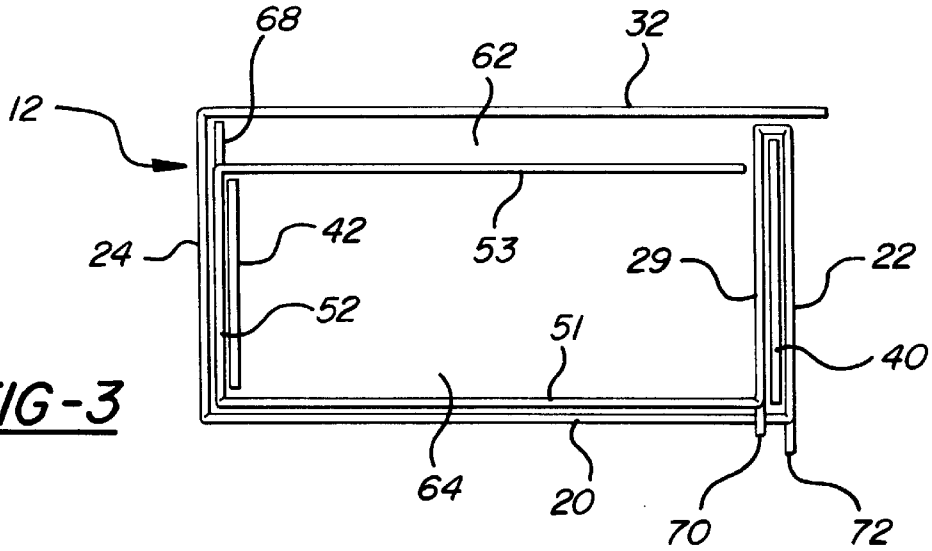
FIG. 3 is a side sectional view of the carton taken along line 3—3 of FIG. 2.
Figure 4:
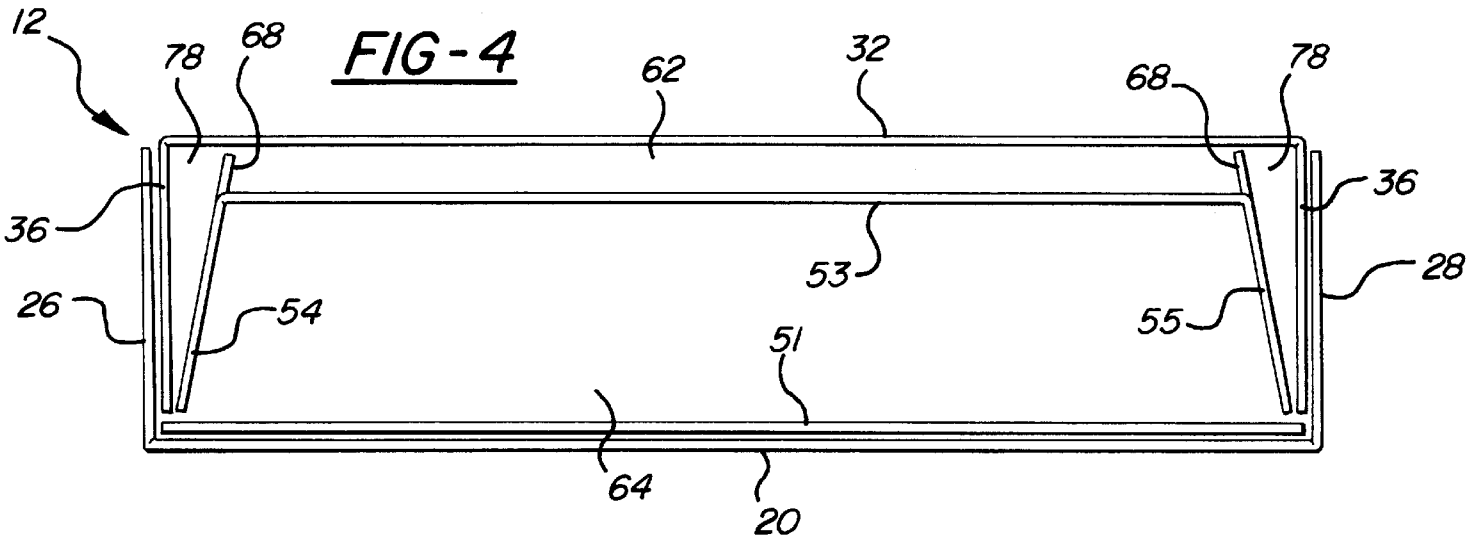
FIG. 4 is a front sectional view of the carton taken along line 4—4 of FIG. 2.

FIG. 1 shows a blank 10 and FIGS. 2, 3, 4 show a box 12 created from blank 10. Referenced components are labeled in FIG. 1; selected components are labeled in other Figures. Corresponding parts between drawings share a same reference numeral. It is noted that the invention is bilaterally symmetrical. Therefore, for simplicity of labeling, some components are indicated by numerals on one side of the drawing only. When this occurs, it is to be understood that the discussion also applies to the corresponding components on the other side, even though those components may not be labeled.

STRUCTURE OF THE INVENTION

Referring now to blank 10 shown in FIG. 1 and also to corresponding box 12 shown in FIGS. 2, 3, and 4, there is a bottom panel 20.

Attached to bottom panel 20 are first, second, third, and fourth walls 22, 24, 26, and 28, respectively. In the embodiment, wall 22 is a front wall, wall 24 is a rear wall, and walls 26 and 28 are left and right side walls, respectively.

Attached to opposing ends of each of side walls 26, 28 are front corner flap 40 and rear corner flap 42. Each flap 40 is attached to the side wall by means of a corner flap fold line 44 which has a flap-receiving slit 46 disposed at the top section of the fold line.

Attached to rear wall 24 is a cover 30 comprising a cover panel 32 and a pair of cover side flaps 36. Cover panel 32 has a front edge 33 that is free of attachment. At the front end of each side flap 36 is a forward-projecting portion 38. In the box format, best shown in FIG. 2, portion 38 is disposed in flap-receiving slit 46. The disposition of side flap 36 with flap-receiving slit 46 provides a frictional engagement between the side flap and the slit. This enables cover 30 to be held in closed position without use of a front flap on the cover panel.

Hingedly linked to a top edge of front wall 22 is an inner panel 29. In the embodiment, panel 29 is linked to wall 22 by two narrowly-spaced parallel fold lines. However, a single fold line could be used, if desired. At a bottom edge of inner panel 29 are a pair of interlock tabs 70 which, in the box format, engage with slots formed by slot-forming slits 72 to hold inner panel 29 parallel to front wall 22, as best seen in FIG. 3.

Attached to the bottom edge of inner panel 29 is a heat-retention structure 50. Structure 50 is a unitary plurality of hingedly connected heat-retention panels comprising a first heat-retention panel 51 attached to inner panel 29, a second heat-retention panel 52 attached to panel 51, a third heat-retention panel 53 attached to panel 52, and fourth and fifth heat-retention panels 54 and 55, respectively, attached to panel 53.

As best shown in FIGS. 3 and 4, in the box format first heat-retention panel 51 faces bottom panel 20 and is disposed approximately parallel to it, second heat-retention panel 52 faces rear wall 24 and is disposed approximately parallel to it, third heat-retention panel 53 faces cover panel 32 and is disposed approximately parallel to it, and fourth and fifth heat-retention panels 54, 55 each face a cover side flap 36.

In the box format, heat-retention panel 53 divides the box into two chambers: an upper air chamber 62 and a lower product-carrying chamber 64. Disposed in panel 53 are four openings each labeled 66. Openings 66 allow steam to vent from lower product-carrying chamber 64 to upper air chamber 62. Openings 66 are created by U-shaped slot-forming slits in the blank (FIG. 1), which are also labeled 66. In addition to creating openings in panel 53, slot-forming slits 66 provide upward projecting tabs 68 which serve to hold panel 53 approximately parallel to cover panel 32. To create upper air chamber 62, the distance between fold lines 73 and 74 (seen in FIG. 1) must be substantially less than the distance between fold lines 75 and 76. The recommended difference in distance is approximately 10 millimeters.

As shown in FIG. 4, heat-retention panels 54 and 55 angle slightly inward from bottom to top. This creates side air chamber 78 between panels 54, 55 and each of cover side flaps 36. To create this arrangement, it is noted that it's necessary to make the left-to-right width of heat-retention panel 53 slightly shorter than the left-to-right width of bottom panel 20. The left-to-right width of panel 53 is the distance between fold lines 82 and 84.

OPTIONAL STRUCTURES

The preferred embodiment may be embellished at least three ways. First, as shown in FIG. 1, additional heat-retention panels may be included as part of heat-retention structure 50. Indicated by phantom lines, optional heat-retention panels 56 and 57 may be attached to panel 51 and optional heat-retention panel 58 may be attached to panel 53.

Figure 5:
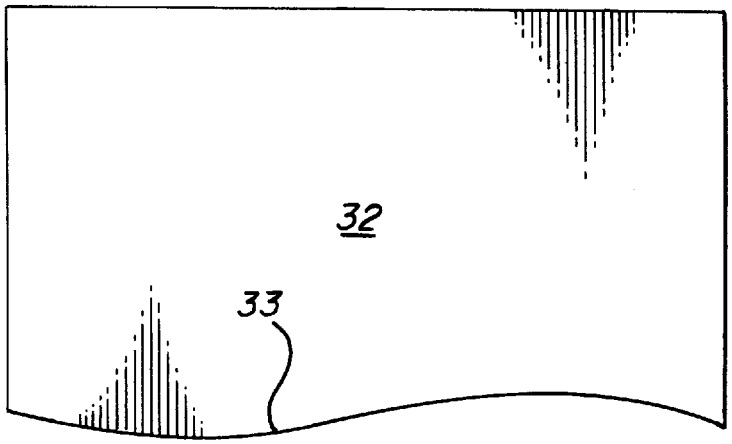
FIG. 5 is a plan view of an alternate shape for the cover panel of the preferred embodiment.

Second, cover panel 32 can be configured into an ornamental shape simply by changing the contour of front edge 33, now a straight line. FIG. 5, which shows edge 33 in a wave-like contour, illustrates an example of an optional alternate shape for cover panel 32.

Third, thermal legs can be added to the carton to raise bottom panel 20 above a table top and, thereby, further reduce heat loss from conduction. The easiest way to accomplish this would be to configure slot-forming slits 72 into thermal legs. For information on the creation, function, and benefits of thermal legs, refer to my U.S. Pat. No. 5,833,130 (Multi-function Pizza Carton).

MANUFACTURE AND OPERATION OF THE INVENTION

To erect blank 10 into box 12, the following procedure is used. It is noted that this is the same procedure that's commonly used for erecting a standard square pizza box having a double-panel front wall. First, simultaneously fold both front corner flaps 40 to upright position and then fold side walls 26, 28 inward or to upright position. Second, fold front wall 22 to upright position and then fold inner panel 29 downward until interlock tabs 70 engage with slots 72. At this point, front wall 22 and side walls 26, 28 will be upright and heat-retention panels 51, 52, and 53 will be overlaying panels 20, 24, and 32, respectively. Third, fold rear corner flaps 42 inward. Fourth, pull cover 30 forward and fold cover side flaps 36 inward so that they will slide within the box cavity. As this is done, heat-retention panels 52–55 automatically slide into place and assume proper position without direct handling. Finally, push cover panel 32 downward onto the box so that forward-projecting portions 38 of cover side flaps 36 slide into flap-receiving slits 46. Because heat-retention structure 50 does not require direct handling, this entire folding procedure takes no more time than the folding of a conventional square pizza box.

When this procedure is completed, rear corner flaps 42 are disposed on an interior side of second heat-retention panel 52 and heat-retention panel 53 divides the box cavity into upper air chamber 62 and lower product-carrying chamber 64.

Due to heat-retention structure 50, a product carried within box 12 is surrounded on all six sides by a minimum of two panels per side (see FIGS. 3, 4). As a result, heat transfer (via conduction and radiation) from a hot food product to the outside air and to a support surface is less than that of a conventional carton.

In addition, as steam escapes from the hot product it rises to upper air chamber 62 and, once inside, condenses on the interior surfaces of the chamber (which are primarily comprised of the interior surface of cover panel 32 and heat-retention panel 53). This has the twofold benefit of keeping the heat released by steam condensation within the box, thereby helping to retain food product temperature, while also keeping the condensation away from contact with the food.

Because of the many panels in this box, it appears that E-flute is the easiest type of corrugated board to use for ease of folding and for fitting cover side flap 36 into flap-receiving slit 46. In addition, many side item foods are very greasy. As a result, it could be beneficial to use a grease-resistant treated or coated paper as one of the two liners in the corrugated board. If this is done, it is recommended that the treated paper be used as the exterior or outer-surface liner. In this configuration, after blank 10 has been erected into box 12, the treated liner on inner panel 29 and heat-retention panels 51–55 will be facing inward and, thereby, providing grease-resistant surfaces for product-carrying chamber 64.

Because the box has dual panels on all six sides, it exhibits a substantial degree of rigidity even when made of lightweight material. Therefore, to conserve cost it might be prudent to consider using a very lightweight paper in manufacture of the corrugated board, particularly if a treated liner is used as described above.

Within the context of this invention, a fold line is shown as a series of aligned spaced short slits in the board. However, it will be appreciated that other methods for making a fold line known to those skilled in the art may be used. In conclusion, as referred to herein, a fold line is any line between two points on the blank or box along which the board is intended to be folded when the blank is being erected into a box.

CONCLUSION, RAMIFICATIONS, AND SCOPE

I have disclosed a carton having:

(a) a heat-retention structure comprising a unitary plurality of hingedly connected heat-retention panels disposed inside the box, or interior to the bottom panel, walls, and/or cover panel of the box; and (b) a cover closure retention means for a cover panel that has no front flap, the cover closure retention means comprising a cover side flap disposed in a flap-receiving slit in a fold line joining a front corner flap to a side wall.

The main object of my invention is a cost-effective carton that provides enhanced heat retention while avoiding condensation build-up. A secondary object of my invention is a corrugated carton that provides a means of retaining the carton's cover in closed position without use of a cover front flap.

The illustrated number, size, shape, type, and placement of components represent the preferred embodiment; however, other combinations and configurations are possible within the scope of the invention, some such combinations being previously described in the prior "Optional Structures" section. In addition, it would be possible to eliminate either one of the two above-described structures, either (a) or (b), from a particular carton and still retain an essence of the invention within that carton. For example, in a particular carton the cover closure retention means (i.e., forward-projecting portion 38 and flap-receiving slit 46) could be eliminated and, to facilitate cover closure of the remaining box, an optional cover front flap could be installed on front edge 33 of cover panel 32. If this were done, the remaining carton containing the heat-retention structure would still be considered to be within the scope of the invention.

The foregoing discussion has pertained mainly to packaging hot food products. However, it should be realized that my invention could be used for other purposes, as well. In conclusion, it is understood that the invention is not to be limited to the disclosed embodiments but, on the contrary, is intended to cover various modifications and equivalent arrangements included within the spirit and scope of the appended claims.

I claim:

1. A carton having an improved cover closure retention means, said carton being of foldable material and comprising:

a plurality of walls including a rear wall, a side wall, and another wall adjacent a front end of said side wall, a cover hingedly attached to said rear wall and comprising a cover panel and a cover side flap attached to a side edge of said cover panel, said cover panel having a front edge free of attachment, a corner flap attached to a front end of said side wall at a corner flap fold line disposed adjacent said another wall;

wherein:

the corner flap fold line of said side wall has a flap-receiving slit at a top section of the fold line, a forward-projecting portion of said cover side flap is disposed in said flap-receiving slit and frictionally engaged therewith, whereby said cover is held in a closed position without use of a front flap on said cover panel, thereby providing a savings of material compared to a conventional box having a cover front flap.

2. A food carton having a heat-retention structure, said carton being of foldable material and comprising:

a bottom panel, a rear wall, a double-panel front wall structure opposing said rear wall and comprising an outer panel attached to said bottom panel and an inner panel hingedly linked through a fold line to a top edge of said outer panel and disposed approximately parallel to said outer panel, said inner panel extending from said fold line to said bottom panel, opposing left and right side walls, left and right front corner flaps attached to a front end of said left and right side walls, respectively, and disposed between the inner and outer panels of said front wall structure, a cover comprising a cover panel hingedly attached to said rear wall, a heat retention structure comprising a first panel attached to the inner panel of said double-panel front wall structure and facing said bottom panel, a second panel attached to said first panel and facing said rear wall, a third panel attached to said second panel and facing said cover panel, fourth and fifth panels attached to said third panel and facing said left and right side walls, respectively;

wherein a distance of at least 3 millimeters exists between said third panel and said cover panel, whereby an upper air chamber between said third panel and said cover panel is provided.

3. The carton of claim 2 wherein:

at least one opening exists in said third panel, whereby steam from hot food product can vent from a product-carrying chamber of said carton to said upper air chamber.

4. The carton of claim 2 further comprising:

first and second rear corner flaps attached to a rear end of said left and right side walls, respectively, said first and second rear corner flaps being disposed on an interior side of said second panel.

5. The carton of claim 4 wherein:

said cover further comprises opposing first and second cover side flaps attached to said cover panel.

6. The carton of claim 5 wherein:

said first cover side flap is disposed between said fourth panel and said left side wall and said second cover side flap is disposed between said fifth panel and said right side wall.

7. The carton of claim 6 wherein:

a first side air chamber exists between said fourth panel and said first cover side flap and a second side air chamber exists between said fifth panel and said second cover side flap.

8. A blank for a paperboard carton, said blank being cut and scored to define:

a bottom panel, a rear wall hingedly attached to said bottom panel, a double-panel front wall structure opposing said rear wall and comprising an outer panel hingedly attached to said bottom panel and an inner panel hingedly linked to a top edge of said outer panel, opposing left and right side walls, each of the side walls being hingedly attached to said bottom panel at a fold line and having a top edge opposing said fold line, wherein the top edge of each of said left and right side walls is free of attachment, left and right front corner flaps hingedly attached to a front end of said left and right side walls, respectively, and disposed adjacent said double-panel front wall structure, a cover comprising a cover panel hingedly attached to said rear wall, a unitary plurality of hingedly connected panels comprising:

(a) a first panel hingedly attached to the inner panel of said double-panel front wall structure, (b) a second panel hingedly attached to said first panel, (c) a third panel hingedly attached to said second panel, (d) fourth and fifth panels hingedly attached to said third panel;

whereby after said blank is erected into a box the first panel faces said bottom panel, the second panel faces said rear wall, the third panel faces said cover panel, and the fourth and fifth panels face said left and right side walls, respectively.

9. The blank of claim 8 wherein:

said unitary plurality of hingedly connected panels further comprises:

sixth and seventh panels hingedly attached to said first panel and each being free of attachment to any other panel.

10. In a carton containing hot food product and having a bottom panel, a rear wall, a double-panel front wall structure opposing said rear wall and comprising an outer panel attached to said bottom panel and an inner panel hingedly linked to said outer panel, left and right side walls, left and right front corner flaps respectively attached to said left and right side walls and disposed between said inner and outer panels, and a cover panel attached to said rear wall, an improvement comprising:

a heat-retaining structure comprising a first panel attached to the inner panel of said double-panel front wall structure and facing said bottom panel, a second panel attached to said first panel and facing said rear wall, a third panel attached to said second panel and facing said cover panel, and fourth and fifth panels attached to said third panel and facing said left and right side walls, respectively.

* * * * *